US005655599A

United States Patent [19]

Kasprzyk

[11] Patent Number: 5,655,599

[45] Date of Patent: Aug. 12, 1997

[54] RADIANT TUBES HAVING INTERNAL FINS

[75] Inventor: Martin R. Kasprzyk, Ransomville, N.Y.

[73] Assignee: Gas Research Institute, Chicago, Ill.

[21] Appl. No.: 493,059

[22] Filed: Jun. 21, 1995

[51] Int. Cl.[6] ..... F28F 1/40

[52] U.S. Cl. ..... 165/133; 165/146; 165/184; 165/DIG. 525; 165/DIG. 517

[58] Field of Search ..... 165/146, 179, 165/184, 133; 126/91 A

[56] References Cited

U.S. PATENT DOCUMENTS

| | | | |
|---|---|---|---|
| 349,060 | 9/1886 | Serve | 165/179 |
| 1,546,592 | 7/1925 | Lawrence | 165/179 X |
| 3,612,175 | 10/1971 | Ford . | |
| 3,779,312 | 12/1973 | Withers, Jr. et al. . | |
| 4,060,379 | 11/1977 | LaHaye et al. | 432/179 |
| 4,062,343 | 12/1977 | Spielman | 126/91 A |
| 4,132,264 | 1/1979 | Furlong . | |
| 4,154,296 | 5/1979 | Fijas . | |
| 4,305,460 | 12/1981 | Yampolsky . | |
| 4,367,791 | 1/1983 | Asami . | |
| 4,438,807 | 3/1984 | Mathur et al. . | |
| 4,789,506 | 12/1988 | Kasprzyk . | |
| 4,921,042 | 5/1990 | Zohler . | |
| 5,071,685 | 12/1991 | Kasprzyk . | |

FOREIGN PATENT DOCUMENTS

| | | | |
|---|---|---|---|
| 1282811 | 12/1961 | France | 165/177 |

OTHER PUBLICATIONS

*Enhanced Ceramic Tubes for High Temperature Waste Heat Recovery,* R.D. Armstrong and A.E. Bergles; Feb. 1989.

*Ceramic Component Manufacturing Technology Development,* I. Ruppel, J. Halstead; Dec. 1985; Gas Research Institute.

Publication: *Advances in Ceramics;* vol. 14; The American Ceramic Society, Inc.; Index and pp. 286–287, 291–296 (1985).

*Primary Examiner*—Allen J. Flanigan

*Attorney, Agent, or Firm*—Hill, Steadman & Simpson

[57] ABSTRACT

An improved radiant heat transfer tube with internal fins is provided. Optimum design characteristics for the number of fins, the height or length of the fins and the twist of the fins is provided to enhance convective and radiant heat transfer from combustion gases inside the tube to the inside surface of the tube. The fin design applies to tubes fabricated from high temperature metal alloys, monolithic ceramics, metal matrix composites or ceramic matrix composites.

7 Claims, 3 Drawing Sheets

FIG. 7
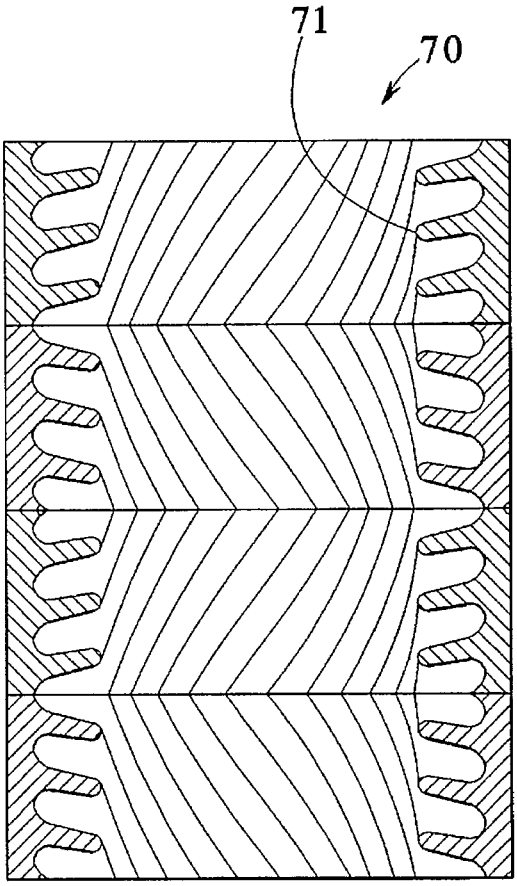
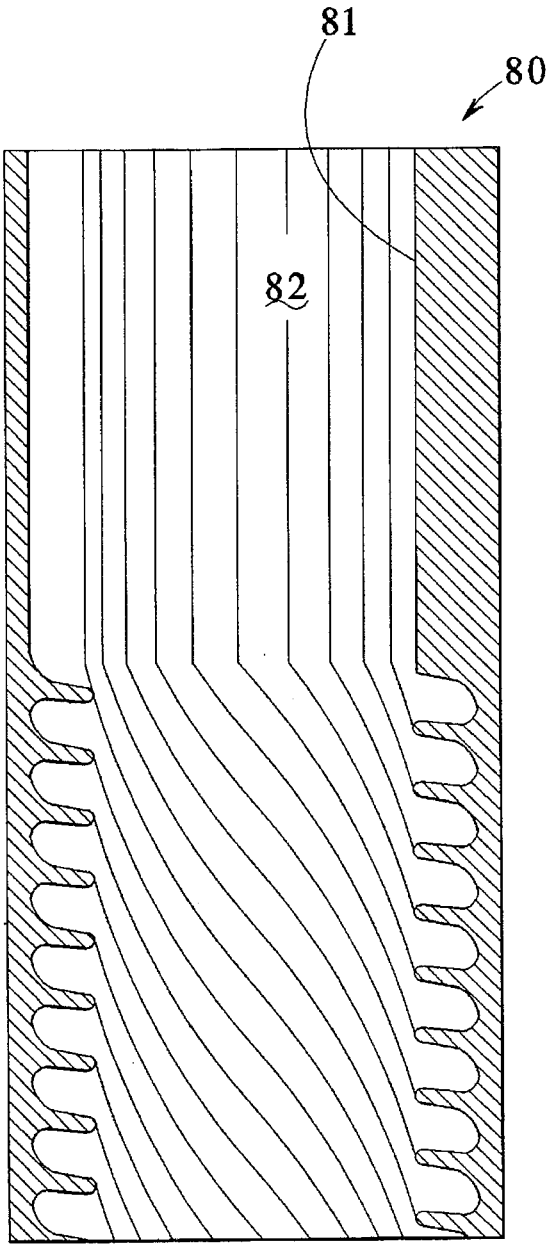
FIG. 8

RADIANT TUBES HAVING INTERNAL FINS

FIELD OF THE INVENTION

This invention relates generally to tubes used in heat transfer processes. More particularly, this invention relates to tubes used in convective and radiant heat transfer. Still more particularly, this invention relates to radiant heat transfer tubes where heat is transferred from gas combusted inside of the tubes to a medium disposed outside of the tube.

BACKGROUND OF THE INVENTION

The use of tubes with internal fins in conventional heat exchangers is well known and design techniques for heat exchanger tubes with internal fins are well documented in the prior art. However, internal fins have not been used in radiant tubes used in furnaces. Further, because the heat transfer mechanics of heat exchanger tubes and radiant tubes are different, the known design techniques used for heat exchanger tubes with internal fins has little applicability to radiant tubes with internal fins. Accordingly, there is a need for radiant tubes with internal fins that are properly designed for more efficient heat transfer.

By way of background, a heat exchanger tube typically carries cool gas or fluid to be heated. Hot gas or fluid flows over the outside of the tube and heat is first transferred from the hot gas or fluid to the tube by convection before heat is transferred through the tube wall by conduction. Finally, heat is transferred to the cooler gas or fluid on the inside of the tube by convection. Radiant heat transfer contributes very little to this process. As noted above, fins have long been used on the inside surfaces of the heat exchanger tubes to enhance the convective heat transfer from the tube to the inside gas or fluid.

However, while the optimum design of internal fins for use in heat exchanger tubes has been investigated and documented, the design of fins for use in radiant tubes has not been explored. In short, there is no data available for the optimum design of fins used in radiant tubes and, further, because radiation plays an important function in the transfer of heat from gases inside of the tube to the tube surface, the fin designs currently available for heat exchanger tubes are relatively inapplicable to fins for radiant tubes.

Any attempt to apply heat exchanger tube fin technology to radiant tube fin technology will be unsatisfactory because the two processes work differently. Specifically, as noted above heat exchanger tubes transfer heat almost exclusively by convection. In contrast, heat from burning gas inside a radiant tube is transferred to the inside tube surface by both convection and radiation. Typically, 10%–30% of the heat from the combustion gases is transferred to the tube wall by radiation, the remaining heat being transferred primarily by convection. Heat is then transferred through the radiant tube by conduction before being transmitted to the cool outside medium primarily by radiation. Thus, the design of internal fins for radiant tubes must take radiant heat transfer as well as convection heat transfer into consideration. Internal fin design for heat exchanger tubes must take only convective heat transfer into consideration.

Further, the cool medium transported through heat exchanger tubes must be pumped. The energy required to pump the cool medium through the heat exchanger tubes is proportional to the pressure drop created across the length of the heat exchanger tube. Thus, the design of fins for heat exchanger tubes must also take into consideration the pressure drop created by the fins. In contrast, the fuel transported through radiant tubes is propelled by combustion of the fuel or gas. Thus, the pressure drop and energy required to pump the fuel through the radiant tubes is not an important factor in the design of internal fins for radiant tubes.

Accordingly, there is a need for a radiant tube fin design that enhances both convective and radiant heat transfer inside the tube. Preferably, the fin design would provide turbulent flow within the tube for enhancing mixing of the combustion gases within the tube thereby eliminating any cold layer of gas along the inside surface of the tube. Further, increased turbulence within the tube will enhance convective heat transfer from the gases to the inside surface of the tube. Further, the radiant tube fin design must also enhance radiant heat transfer from the combustion gases to the tube. Therefore, the geometries of the fins should be such that enhancement of convective heat transfer is balanced with the enhancement of radiant heat transfer.

SUMMARY OF THE INVENTION

The aforenoted needs are addressed by the present invention which comprises a radiant tube for effectively transferring heat from combustion gases flowing through the inside of the tube to an outside medium. The radiant tube of the present invention includes an interior surface which features a plurality of inwardly projecting fins. The fins of the present invention are of a height or length ranging from 10% of the radius of the tube to 60% of the radius of the tube. Substantial fuel savings have been achieved with fins having heights of approximately 40% of the tube radius. It is further believed that substantial fuel savings will be achieved with fins having heights approaching 50% of the tube radius.

The number of fins can vary from 10 to 40 fins. However, when using fins of increased height, i.e. 35% to 50% of the tube radius, the fins should number between 10 and 20. By providing fins in the range of 10 to 20, the geometry of the tube will enable radiant heat transfer to take place from the inner tips of the fins toward the inside surface of the tube between two adjacent fins. An excessive amount of "crowding" of the fins will essentially "block" the desired radiant heat transfer. It is also further believed that excessive "crowding" of the fins will inhibit mixing of the combustion gases and may prevent hot combustion gases from engaging the inside surface of the tube between adjacent fins.

To increase turbulence within the tube which enhances convective heat transfer, the fins also preferably twist as they extend down the tube in a helical fashion. The twist "angle" of the fins can be defined as the angle between the fin and the longitudinal axis of the tube. The twist angle can range from approximately 26° (which equals on turn per sixteen inches of tube for a 2.5" ID tube) to 58° (which equals one turn per five inches of tube for a 2.5" ID tube). One especially effective twist angle was 41° (which equals one turn per nine inches of tube for a 2.5" ID tube). If the twist angle is too great, i.e. greater than 58°, the fins may inhibit mixing of the combustion gases against the inside surface of the tube between the fins. In effect, hot gases may not effectively reach the inside surface of the tube wall disposed between adjacent finds. Further, a twist angle that is too great may also inhibit heat transfer between the distal tips of the fins and the inside wall surface disposed between adjacent fins.

The twist of the fins can also be described in terms of "twist rate". The twist rate of the fins can be defined as the number of turns per unit length of tube. The chosen unit length of tube is equal to the radius of the tube. Thus, the twist rate can be defined as the number of turns the fins make per length of tube equal to the radius of the tube. The twist rate can range from approximately 0.078 (which equals one turn per sixteen inches of tube for a 2.5" ID tube) to 0.25 (which equals one turn per five inches of tube for a 2.5" ID tube). One especially effective twist rate is about 0.139 (which equals one turn per nine inches of tube for a 2.5" ID tube).

It is therefore an object of the present invention to provide an improved radiant tube for effectively transferring heat between combustion gases disposed inside the tube and a medium disposed outside of the tube.

Yet another object of the present invention is to provide an optimum fin design for radiant tubes.

Still another object of the present invention is to provide a radiant tube with internal fins.

And another object of the present invention is to provide dimensionless design parameters for internal fins of radiant tubes.

Other objects and advantages of the invention will become apparent upon reading the following detailed description of the drawings and appended claims, and upon reference to the accompanying drawings.

BRIEF DESCRIPTION OF THE DRAWINGS

This invention is illustrated more or less diagrammatically in the accompanying drawings wherein:

FIG. 7 is a side sectional view illustrating a finned radiant tube fabricated in accordance with the present invention featuring fins that twist helically in a first direction before reversing and twisting helically in a second opposing direction; and FIG. 8 is a side sectional view of the tube illustrated in FIG. 5 further illustrating a gap disposed along the straight section of fins.

Figure 1:
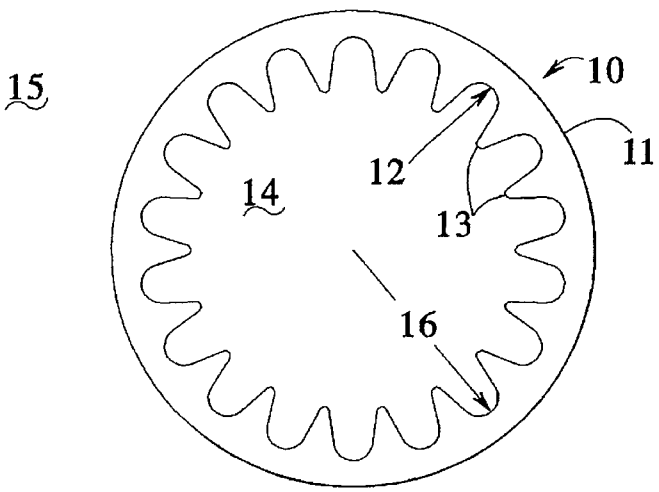
FIG. 1 is a sectional view of one radiant tube with internal fins made in accordance with the present invention.

It should be understood that the drawings are not necessarily to scale and that the embodiments are illustrated by sectional views. In certain instances, details which are not necessary for an understanding of the present invention or which render other details difficult to perceive have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

The present invention is best understood upon consideration of how heat exchanger tubes work and how they are distinguishable in both design and function from the radiant tubes of the present invention. Specifically, heat exchanger tubes typically have fins having heights of between 2% and 6% of the internal radius of the tube. The relatively low or short fin height is utilized to avoid a large pressure drop across the length of the tube. However, because the fins are short, a large number of fins, perhaps fifty, can be accommodated in a 2.5" internal diameter (ID) tube. The optimum height and number of internal fins has been established through extensive empirical studies by the heat exchanger community. Further, recent numerical modeling with computers has reached the point where optimum configurations can be easily selected for various heat exchanger applications. The optimum configurations are selected to enhance convective heat transfer from the interior surface of the tube to the inside medium and with an acceptable pressure drop across the length of the tube.

On the other hand, there is no public information regarding optimum internal fin designs for radiant tube applications, apparently because radiant tubes with internal fins are not available. To fulfill this need, four radiant tubes fabricated in accordance with the present invention are presented in Figures 1 through 4.

First referring to FIG. 1, the tube 10 features an outside surface 11 and an inside surface 12 that is equipped with eighteen inwardly directed fins indicated generally at 13. The tube 10 transmits heat generated by combustion gases as they pass through the interior of the tube, indicated generally at 14. Heat will be transferred from the combustion gases by way of radiation and convection to the inside surface 12 of the tube 10. The heat is then transmitted through the tube 10 by way of conduction until it is transmitted to the exterior of the tube 15, principally by radiation. The fins 13 act to enhance the transfer of heat by both convection and radiation to the inside surface 12 of the tube 10.

Referring to FIGS. 1 through 4 collectively, the primary difference between the tubes 10, 20, 30, and 40 is the height of the fins 13, 23, 33 and 43 respectively. Referring to FIG. 1, the fins 13 have a height equal to approximately 20% of the inside radius 16 of the tube 10 (or 10% of the inside diameter of the tube 10). In contrast, referring to FIG. 2, the fins 23 have a height equal to approximately 30% of the inside radius 26 of the tube 20; referring to FIG. 3, the fins 33 have a height equal to approximately 40% of the inside radius 36 of the tube 30; and, referring to FIG. 4, the fins 43 have a height equal to approximately 50% of the inside radius 46 of the tube 40.

Figure 2:
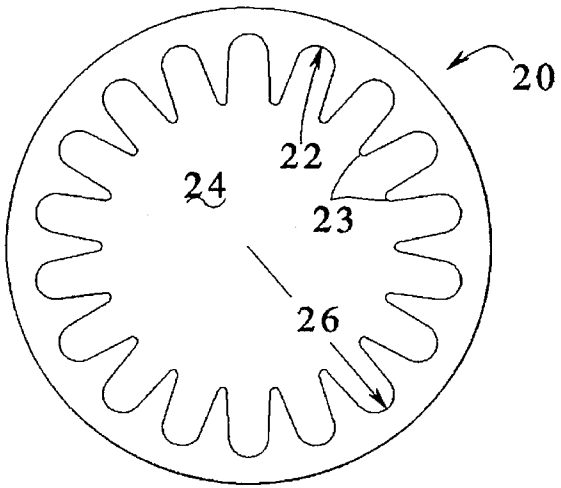
FIG. 2 is a sectional view of a second radiant tube with internal fins made in accordance with the present invention.
Figure 3:
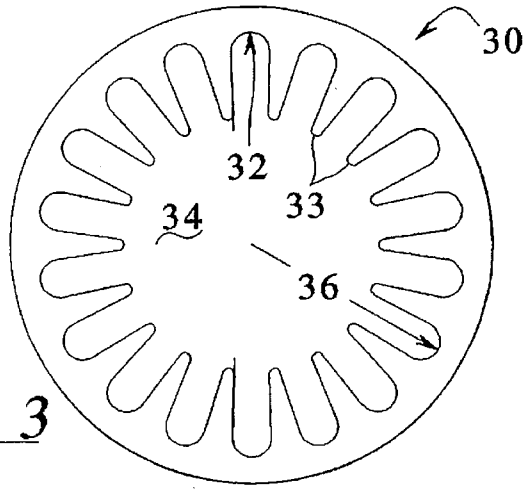
FIG. 3 is a sectional view of a third radiant tube with internal fins made in accordance with the present invention.
Figure 4:
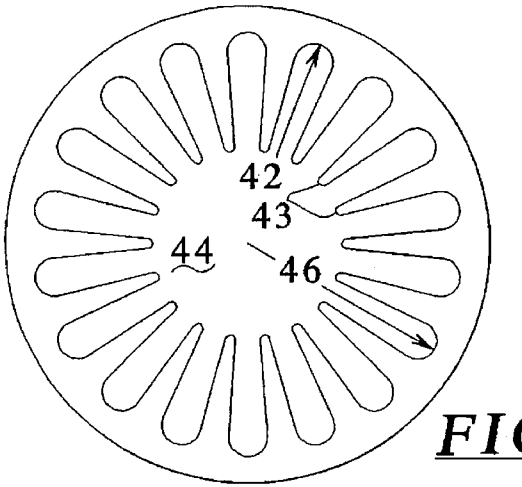
FIG. 4 is a sectional view of a fourth radiant tube with internal fins made in accordance with the present invention.

In addition to the length of the fins 13, 23, 33 and 43, the preferred embodiments of the present invention also feature fins that twist in a helical fashion down the length of the tube. The "twist angle" of the twist can be defined as the angle between the fins and the longitudinal axis of the tube. The twist angle can vary from about 26° (or one complete rotation of a fin per sixteen inches of tube for a 2.5" ID tube) to 58° (or one complete turn of a fin per five inches of tube for a 2.5" ID tube). It has been found that a "high" twist angle such as 58° can interfere with the flow of the combustion gases inside the interior space 14 (or 24, 34 or 44 as shown in FIGS. 2, 3 and 4 respectively). By interfering with the flow of the combustion gases, hot gases may not reach the inside surfaces 12, 22, 32 and 42. The preferred twist angle has been found to be approximately 41° (or one turn per nine inches of tube for a 2.50" ID tube).

Figure 5:
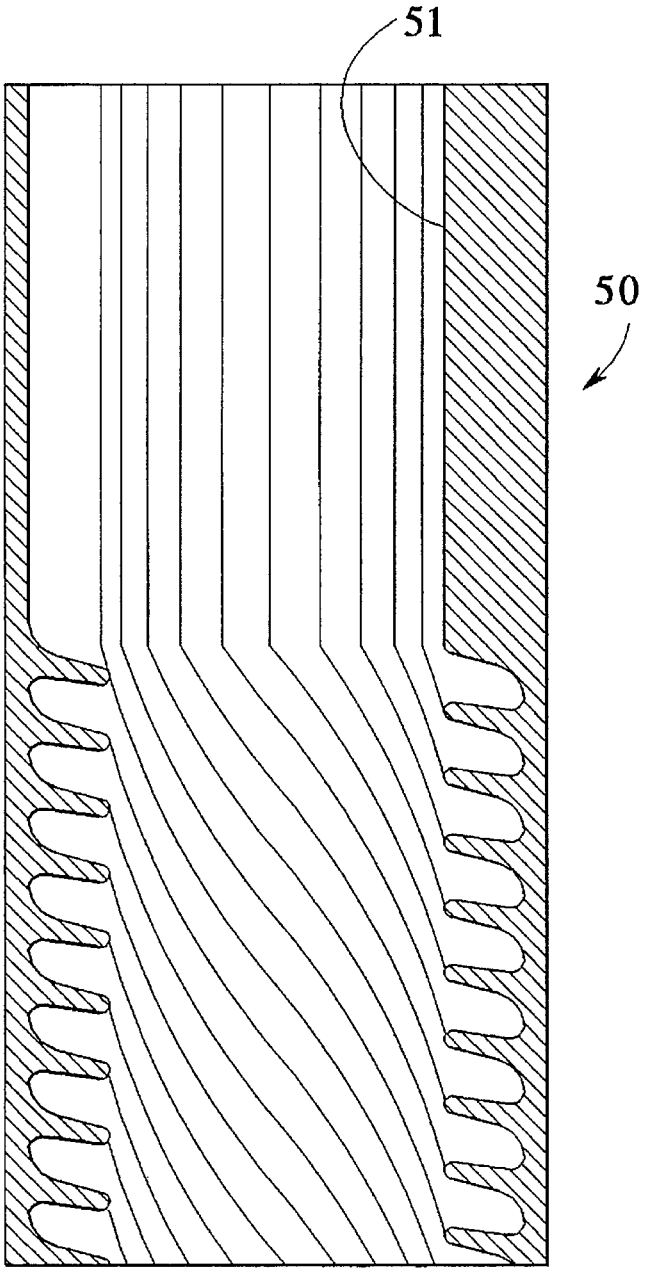
FIG. 5 is a side sectional view illustrating a finned radiant tube fabricated in accordance with the present invention featuring fins that extend straight along the tube before twisting helically.
Figure 6:
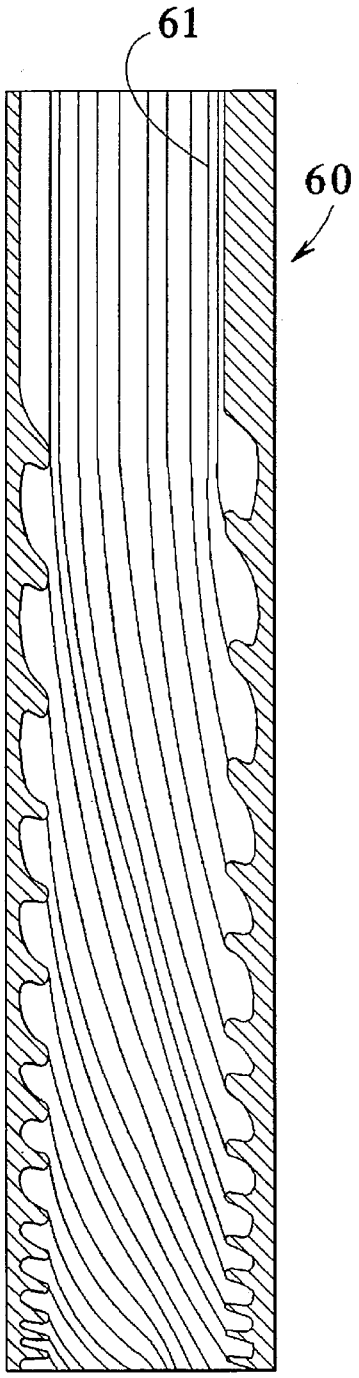
FIG. 6 is a side sectional view illustrating a finned radiant tube fabricated in accordance with the present invention featuring fins twisting helically at varying rates.

FIGS. 5 through 8 illustrate varying design features that may be incorporated into the finned tubes of the present invention. Specifically, FIG. 5 illustrates a tube 50 which features fins 51 that extend along the tube 50 in a straight manner or at a 0° twist angle before twisting helically at a relatively uniform twist rate. FIG. 6 illustrates a tube 60 with fins 61 that extend along the tube in a straight manner or a 0° twist angle before twisting helically at varying rates. FIG. 7 illustrates a tube 70 that features fins 71 that twist helically in a first direction before reversing and twisting helically in a second opposing direction. And, FIG. 8 illustrates a tube 80 that features fins 81 that extend down the tube in a straight manner or at a 0° twist angle before being interrupted by a gap illustrated at 82 before extending along the tube in a straight manner again before twisting helically at a relatively uniform twist angle. It will be apparent to those skilled in the art that these and other variations may be made in the fin design in accordance with the present invention.

Thus, the present invention involves the optimization of three different fin variables: number of fins, height of fins and the twist angle.

Silicon-silicon carbide (Si—SiC) composite radiant heat tubes were made with a 2.75" OD and 54.25" length which is a common size used in Ipsen heat treating furnaces. The control tube was made with a 0.125" thick wall and an ordinary round 2.5" ID inside surface as normally used and commercially available radiant tubes. Experimental tubes of the same size were made with fins projecting inward from the inside surface. The tubes were made with 18, 30 and 40 fins. The fin heights range from 0.25" (20% of tube radius), 0.375" (30% of tube radius) and 0.5" (40% of tube radius). The twist angles tried were straight (0°), one turn in sixteen inches (26°), one turn in nine inches (41°) and one turn in five inches (58°).

Pyronics, Inc. of Cleveland, Ohio tested the above-referenced tubes in a small scale laboratory furnace. The laboratory furnace was built to test one 54.25" long, 2.75" OD tube at a time and was operated to simulate a large Ipsen type metal heat treating batch furnace which, of course, requires a plurality of tubes (typically 8 to 24). The laboratory furnace permitted the investigation of fin variables on a single tube without having to manufacture many tubes of the same configuration which would have been required if the testing took place in a production Ipsen furnace.

The experiment simulated a common steel heat treating operation which involves heating a steel load up to 1800° F. followed by holding the steel at that temperature for a length of time. The experimental furnace was fired up to 1800° F. and then the temperature was held for one hour to stabilize the furnace. Stainless steel rods at room temperature were then lowered into the hot furnace. After the furnace recovered to its 1800° F. set point, it was held at that temperature for one hour. The amount of gas fuel consumed during this hold portion of the cycle was recorded. The fuel consumption during the hold portion of the cycle for fin tubes was then compared to the round ID control tube and the results were reported as percent fuel savings over a round tube.

The results are tabulated below:

EXAMPLE 1

| Fin height = 20% of IR (0.25") | | |
|---|---|---|
| | Twist angle (inches per rotation) | |
| No. Fins | 0 (Straight) | 26° (16) |
| 18 | 9.8% | 14.3% |
| 30 | — | 12.9% |
| 40 | — | 15.2% |

EXAMPLE 2

| Fin height = 30% of IR (0.375") | | | | |
|---|---|---|---|---|
| | Twist angle (inches per rotation) | | | |
| No. Fins | 0 (Straight) | 26° (16) | 41° (9) | 58° (5) |
| 18 | 18.7% | 15.2% | 25.9% | 24.1% |

EXAMPLE 3

| Fin height = 40% of IR (0.50") | |
|---|---|
| No. Fins | Twist angle (inches per rotation) 41° (9) |
| 18 | 32.1% |

Thus, it can be seen that the largest percentage fuel savings (32.1%) was provided by the tube with eighteen fins with a twist angle of 41° or one turn for every nine inches of tube for a 2.75 OD tube (2.5 inch I.D.). It is anticipated that the design characteristics, i.e. number of fins, fin height as expressed as a percentage of radius, and twist angle, will remain constant for tubes of varying diameters. That is, the number of fins, height of fins (in terms of percentage of tube radius) and twist angle will remain relatively the same for tubes of 2.75" OD or 8" OD.

It is further anticipated that fuel savings of greater than 32.1% can be obtained with larger fins, such as fins approaching the height of 50% of the tube radius as illustrated in FIG. 4.

The above-referenced designs apply to tubes manufactured from high temperature metal alloys, monolithic ceramics, metal matrix composites and ceramic matrix composites. The above-described radiant tubes may be manufactured from Si—SiC composite material in accordance with U.S. Pat. Nos. 4,789,506 and 5,071,685, both issued to Kasprzyk.

Although only selected embodiments and examples of the present invention have been illustrated and described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

What is claimed is:

1. A radiant tube for effectuating radiant heat transfer from combustion gases disposed inside the tube to objects to be heated or a fluid medium to be heated disposed outside the tube, the tube having a longitudinal axis, the tube comprising:

an interior surface having an inside radius, the tube also having a length, the interior surface including a plurality of radially inwardly projecting fins, the fins having heights ranging from 10% of the radius of the tube to 60% of the radius of the tube, the fins further being characterized as spiralling helically at varying twist rates along the length of the tube.

2. The tube of claim 1, wherein the fins are further characterized as being straight for at least one portion of the tube.

3. The tube of claim 1, wherein the fins are further characterized as spiralling helically along a first portion of the tube before spiralling in a reverse direction along a second portion of the length of the tube.

4. A radiant tube for effectuating radiant heat transfer from combustion gases disposed inside the tube to objects to be heated or a fluid medium to be heated disposed outside the tube, the tube having a longitudinal axis, the tube comprising:

an interior surface having an inside radius, the tube also having a length, the interior surface including a plurality of radially inwardly projecting fins, the fins having heights ranging from 10% of the radius of the tube to 60% of the radius of the tube, the fins further being characterized as spiralling helically at varying twist rates along the length of the tube and being straight for at least one portion of the tube.

5. A gas-fired radiant tube for effectuating radiant heat transfer from combustion gases disposed inside the tube to a space to be heated outside the tube, the tube having a longitudinal axis, the tube comprising:

a monolithic tube fabricated from Si—SiC composite, the tube having an inside radius, the tube including an exterior surface, the exterior surface effectuating radiant heat transfer from the tube to the surrounding fluid medium, the tube including an interior surface, the interior surface including from about 10 to about 20 inwardly projecting fins for enhancing convective and radiant heat transfer from the combustion gases to the interior surface of the tube, the fins having heights ranging from 30% of the inside radius of the tube to 50% of the inside radius of the tube, the fins having a rough inward-facing surface for engaging the combustion gases, the fins rotating helically along the length of the tube, each fin rotating around the interior surface of the tube at an angle from about 30° to about 50° with respect to the longitudinal axis of the tube, the fins being further characterized being straight for at least one portion of the tube.

6. A gas-fired radiant tube for effectuating radiant heat transfer from burning combustion gases disposed inside the tube to space to be heated disposed outside the tube, the tube having a longitudinal axis, the tube comprising:

a monolithic tube fabricated from Si—SiC composite, the tube having an inside radius, the tube including an exterior surface, the exterior surface effectuating radiant heat transfer from the tube to the surrounding fluid medium, the tube including an interior surface, the interior surface including from about 10 to about 20 inwardly projecting fins for enhancing convective and radiant heat transfer from the burning combustion gases to the interior surface of the tube, the fins having heights ranging from 30% of the inside radius of the tube to 50% of the inside radius of the tube, the fins having a rough inward-facing surface for engaging the combustion gases, the fins rotating helically along the length of the tube, each fin rotating around the interior surface of the tube at an angle from about 30° to about 50° with respect to the longitudinal axis of the tube, the fins being further characterized as spiraling helically at varying twist rates along the length of the tube.

7. A gas-fired radiant tube for effectuating radiant heat transfer from burning combustion gases disposed inside the tube to space to be heated disposed outside the tube, the tube having a longitudinal axis, the tube comprising:

a monolithic tube fabricated from Si—SiC composite, the tube having an inside radius, the tube including an exterior surface, the exterior surface effectuating radiant heat transfer from the tube to the surrounding fluid medium, the tube including an interior surface, the interior surface including from about 10 to about 20 inwardly projecting fins for enhancing convective and radiant heat transfer from the burning combustion gases to the interior surface of the tube, the fins having heights ranging from 30% of the inside radius of the tube to 50% of the inside radius of the tube, the fins having a rough inward-facing surface for engaging the combustion gases, the fins rotating helically along the length of the tube, each fin rotating around the interior surface of the tube at an angle from about 30° to about 50° with respect to the longitudinal axis of the tube, the fins being further characterized being straight for at least one portion of the tube.

* * * * *